US007489224B2

(12) United States Patent
Berens et al.

(10) Patent No.: US 7,489,224 B2
(45) Date of Patent: Feb. 10, 2009

(54) FERRITE CORE, AND FLEXIBLE ASSEMBLY OF FERRITE CORES FOR SUPPRESSING ELECTROMAGNETIC INTERFERENCE

(75) Inventors: Jessica Rose Berens, Rochester, MN (US); Don Allan Gilliland, Rochester, MN (US); Amanda Elisa Ennis Mikhail, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 11/523,074

(22) Filed: Sep. 19, 2006

(65) Prior Publication Data

US 2007/0013470 A1 Jan. 18, 2007

Related U.S. Application Data

(62) Division of application No. 10/879,811, filed on Jun. 29, 2004, now Pat. No. 7,138,896.

(51) Int. Cl.
*H01F 27/24* (2006.01)

(52) U.S. Cl. ..... 336/212

(58) Field of Classification Search ..... 336/212
See application file for complete search history.

(56) References Cited

U.S. PATENT DOCUMENTS

| | | | | |
|---|---|---|---|---|
| 2,832,133 | A * | 4/1958 | Giacosa | 72/339 |
| 5,095,296 | A | 3/1992 | Parker | |
| 5,200,720 | A | 4/1993 | Yi et al. | |
| 5,530,634 | A * | 6/1996 | Smith | 362/221 |
| 5,569,789 | A | 10/1996 | Bell et al. | |
| 5,990,756 | A | 11/1999 | France, Jr. et al. | |
| 6,002,211 | A * | 12/1999 | Van Der Zaag et al. | 315/248 |
| 6,040,753 | A | 3/2000 | Ramakrishnan et al. | |
| 6,072,125 | A | 6/2000 | Takeuchi et al. | |
| 6,147,928 | A | 11/2000 | Onizuka et al. | |
| 6,242,691 | B1 | 6/2001 | Reese et al. | |
| 6,346,673 | B1 | 2/2002 | Onizuka et al. | |
| 6,369,687 | B1 * | 4/2002 | Akita et al. | 336/234 |
| 6,482,017 | B1 | 11/2002 | Van Doorn | |
| 6,534,708 | B2 | 3/2003 | Ono et al. | |
| 6,623,275 | B1 | 9/2003 | Pavlovic et al. | |
| 2001/0042632 | A1 | 11/2001 | Manov et al. | |
| 2002/0125034 | A1 | 9/2002 | Kuo | |
| 2003/0109175 | A1 | 6/2003 | Skinner et al. | |
| 2005/0012583 | A1 | 1/2005 | Sutardja | |

FOREIGN PATENT DOCUMENTS

| | | | | |
|---|---|---|---|---|
| DE | 3210466 | A * | 9/1983 | |
| EP | 1020875 | | 7/2000 | |
| EP | 1164665 | | 12/2001 | |
| GB | 2025150 | A * | 1/1980 | 174/DIG. 25 |
| JP | 2001351818 | | 12/2001 | |

* cited by examiner

*Primary Examiner*—Elvin G Enad
*Assistant Examiner*—Joselito Baisa
(74) *Attorney, Agent, or Firm*—Rabin & Berdo P.C.

(57) ABSTRACT

Ferrite cores are provided with rounded, convex head ends and complimentary rounded, concave tail ends. The configuration of the head and tail ends permits a reduction in gap width between adjacent cores when they are joined together into a core assembly that suppresses electromagnetic interference emitted from a cable.

19 Claims, 9 Drawing Sheets

FERRITE CORE, AND FLEXIBLE ASSEMBLY OF FERRITE CORES FOR SUPPRESSING ELECTROMAGNETIC INTERFERENCE

CROSS-REFERENCE TO RELATED APPLICATION

This is a division of application Ser. No. 10/879,811, filed Jun. 29, 2004, now U.S. Pat. No. 7,138,896 the entire disclosure of which is incorporated herein by reference.

BACKGROUND OF THE INVENTION

The present application is directed to a ferrite core and to a ferrite core assembly for suppressing electromagnetic interference (EMI), and more particularly to an assembly of ferrite cores that are configured to fit together flexibly, with enhanced magnetic coupling between the cores.

A cable that carries analog signals or digital signals has a tendency to act as an antenna, radiating energy in the form of electromagnetic radiation. This tendency depends on several factors, including the frequency of the signals and the length and geometric layout of the cable. The electromagnetic radiation emitted by a cable increases the noise level of the electromagnetic environment. That is, it may create electromagnetic interference (EMI). It is known that one or more ferrite cores may be placed on a cable to suppress the effects of EMI. To be effective, the core or cores should allow the magnetic flux produced by current in the cable to flow through the ferrite material. The EMI suppression effect of ferrite cores is reduced if air gaps exists between the cores.

Ferrite cores are generally produced by sintering suitable materials into rigid bodies, which materials are known in the art. Such materials include, for example, MnZn for lower frequencies and NiZn for middle and higher frequencies. The sintered ferrite material is dense and brittle, and can be somewhat bulky. The use of ferrite cores to suppress EMI can therefore be challenging from an electronics packaging perspective.

In preassembled cable assemblies, ferrite cores are typically retained on a cable at a particular location with a plastic shrink-wrap. Cables may also be retrofit with ferrite cores by mounting the cores in plastic housings that are then clipped or clamped to the cable. Both of these ferrite core solutions for reducing EMI are detrimental to compact and inexpensive system packaging, since there are usually tight space limitations and since the ferrite cores not only take up space and block air flow, but they also limit the flexibility of the cable.

SUMMARY OF THE INVENTION

One object of the invention is to provide ferrite cores having a configuration which permits them to be linked together in a flexible assembly.

Another object is to provide ferrite cores which are configured to minimize gaps between the cores.

A further object is to provide ferrite cores that can be used to provide a single toroidal EMI suppressor around a cable, an elongated EMI suppressor that is wrapped helically around a cable, or an elongated EMI suppressor that is attached to a side or face of a flat cable.

In accordance with one aspect of the present invention, these and other objects that will become apparent from the ensuing detailed description can be attained by providing a ferrite core assembly, for use with a signal-carrying cable to suppress electromagnetic interference radiated by the cable, that includes a plurality of ferrite cores. Each ferrite core has a head end with a rounded, convex shape and a tail end with a rounded, concave shape that provides a recess at the tail end. The ferrite cores are assembled in an articulated, flexible sequence such that the head ends of at least some of the ferrite cores extend into the recesses of adjacent ferrite cores.

The head end of each ferrite core may have approximately the shape of a portion of a cylinder having a predetermined radius, and the tail end may also have approximately the shape of a portion of a cylinder with a radius that is approximately the same as the predetermined radius. As a result, adjacent ferrite cores fit together in what might be called a "cylinder-and-socket" arrangement (a phrase inspired by the more-familiar term, "ball-and-socket"). Due to the cylinder-and-socket engagement, adjacent ferrite cores are movable with respect to one another, and moreover the gap between them is minimized.

The head end of each ferrite core may have approximately the shape of a portion of a sphere having a predetermined radius, and the tail end may also have approximately the shape of a portion of a sphere with a radius that is approximately the same as the predetermined radius. This provides a true ball-and-socket joint, with advantages similar to those discussed above that flow from a cylinder-and-socket joint.

In accordance with another aspect of the invention, a plurality of ferrite cores are joined together into a group. Each ferrite core is made of sintered material, and has a curved head end with a rounded, convex shape and a curved tail end with a rounded, concave shape that provides a recess at the tail end. The ferrite cores are joined together in a flexible sequence, with the head ends all facing in one direction and the tail ends facing in the opposite direction. Ferrite cores joined together in this way may then be conveniently used later to fabricate core assemblies for suppressing electromagnetic interference from signal-carrying cables.

Among other options, the ferrite core assemblies may be joined together using one or more filaments that extend through bores in the ferrite cores. Alternatively, link members may be used to pivotably join pairs of adjacent ferrite cores. Another option is to tack the ferrite cores to a flexible tape.

According to a further aspect of the invention, a ferrite core for use in a ferrite core assembly to suppress electromagnetic interference includes a body of sintered ferrite material. The body has a curved head end with a rounded, convex shape and a curved tail end with a rounded, concave shape. The concave shape conforms substantially to the convex shape.

DESCRIPTION OF THE PREFERRED EMBODIMENTS

Three preferred embodiments of the invention, and variations thereof will now be described with reference to the accompanying drawings.

The First Embodiment

Figure 1:
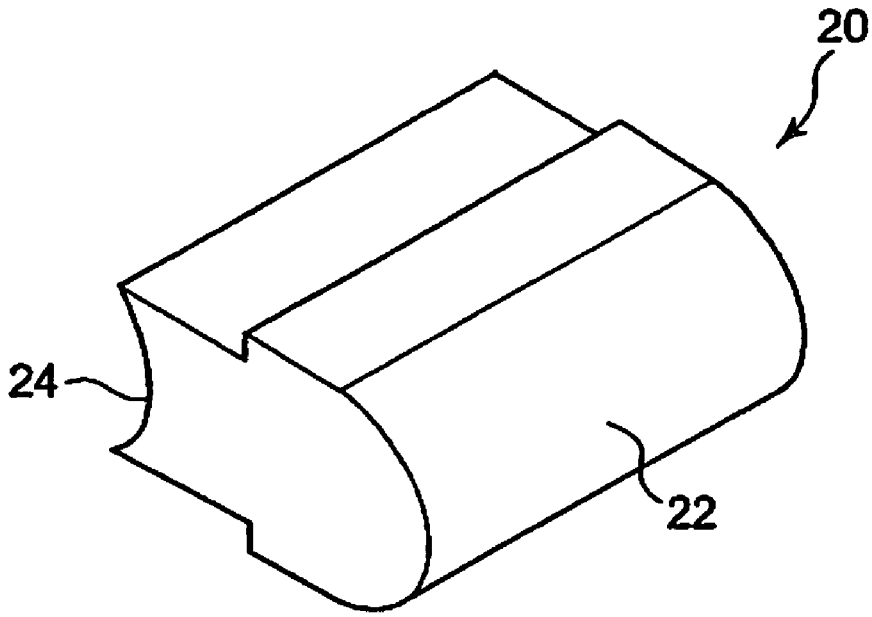
FIG. 1 is a perspective view illustrating a ferrite core in accordance with a first embodiment of the present invention.
Figure 2:
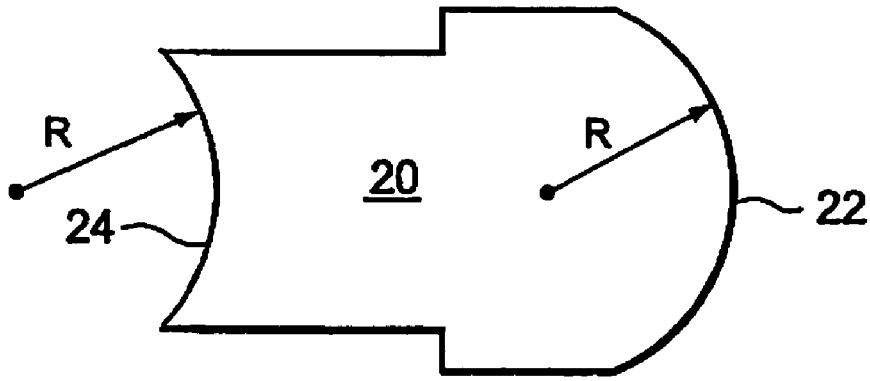
FIG. 2 is a top plan view of the ferrite core shown in FIG. 1.

With initial reference to FIGS. 1 and 2, a ferrite core 20 has a front or head end 22 and a back or tail end 24. The head end 22 has a curved, convex shape and the tail end 24 has a curved, concave shape. Specifically, the head end 22 is shaped as a segment of the cylinder having a radius R and, similarly, the tail end 24 is shaped as a segment of the cylinder having the radius R or a radius slightly greater than R. It will be apparent, then, that the head end 22 of one ferrite core 20 can be accommodated in a recess provided at the tail end 24 of an adjacent ferrite core in a manner of a cylinder-and-socket joint.

Figure 3:
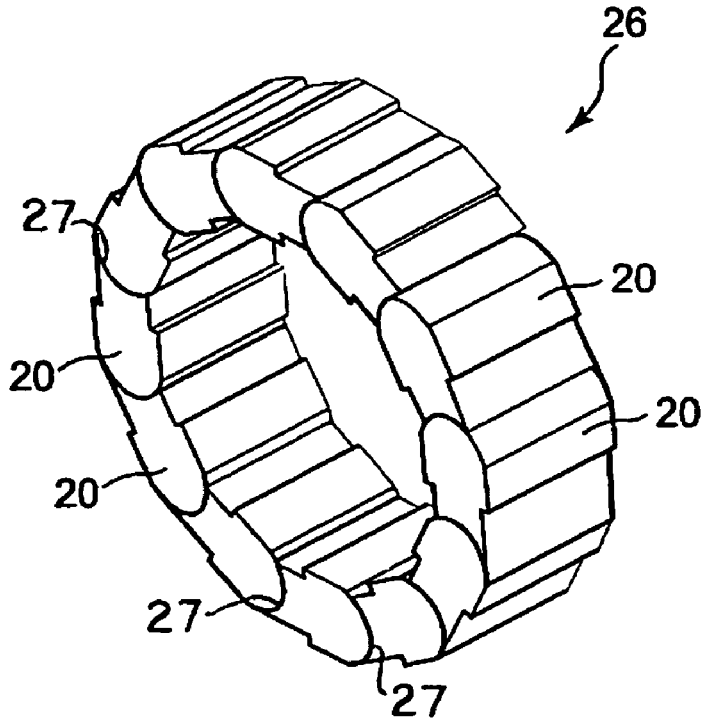
FIG. 3 is a perspective view of a ferrite core assembly made of ferrite cores as shown in FIG. 1.

FIG. 3 illustrates an example of a ferrite core assembly 26 formed by a number of ferrite cores 20 that had been arranged, head-end to tail-end, in a toroidal configuration. Since the head ends fit snuggly against the tail ends of the ferrite cores 20, the gaps 27 between the ferrite cores have minimal gap widths. The core assemblies 26 conform to a cable that is round or oval in cross section. Cables with different cross sectional areas can be accommodated by varying the number of cores 20 in the assembly 26 or by varying the size or length of the cores.

Figure 4:
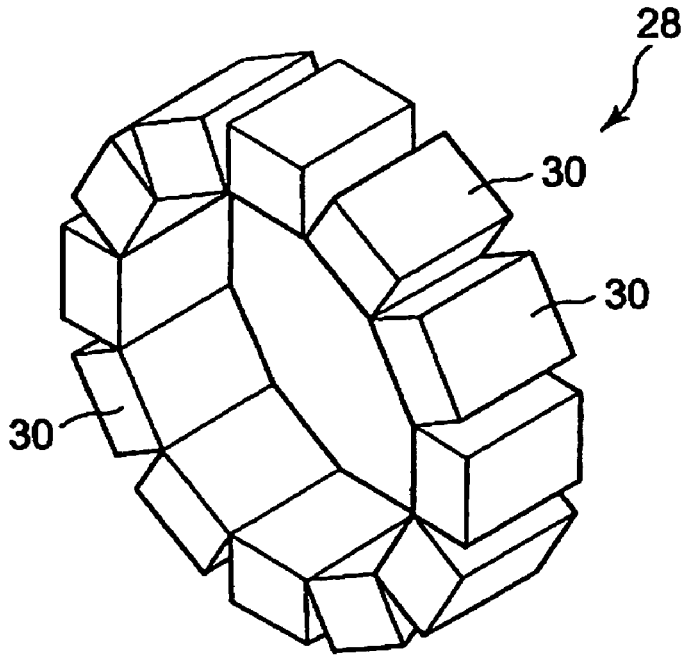
FIG.4 PRIOR ART
FIG. 4 is a perspective view of a prior art ferrite core assembly that is made from brick-shaped ferrite cores.

A very significant advantage that is provided by ferrite cores 20 can be appreciated by comparing the prior art arrangement shown in FIG. 4 with the core assembly 26 shown in FIG. 3. In FIG. 4, a toroidal coil assembly 28 is formed from brick-shaped ferrite cores 30. Except at their inner edges, it will be seen that the sides of the cores 30 are separated by gaps. This increases the magnetic resistance provided by the core assembly 28, which reduces the EMI suppression provided by the core assembly 28. These gaps could be avoided by making the cores 30 trapezoidal in cross section, so that the cores 30 would be generally keystone-shaped, but the angle needed for the sides of the cores 30 in order to avoid gaps would vary with the cross sectional area of the core assembly. Furthermore, the assembly would be inflexible from cable application to cable application.

Figure 5:
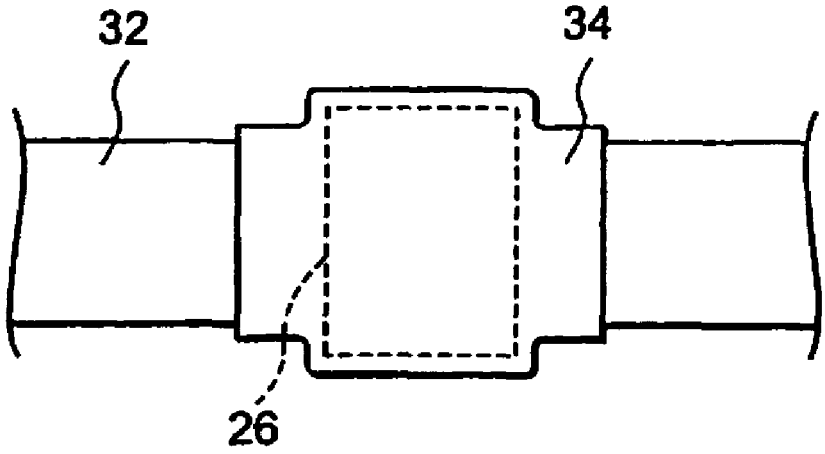
FIG. 5 is a top view of a ferrite core assembly that is attached to a cable with the aid of heat-shrunk tubing.

FIG. 5 illustrates an example of how the core assembly 26 that is shown in FIG. 3 can be mounted on a cable 32. The core assembly 26 is threaded onto the cable 32 and enclosed in a segment of tubular heat-shrink plastic. Hot air is then blown against the heat-shrink plastic, which contracts to form a cover 34 that not only secures the core assembly 26 to the cable 32, but also urges the individual ferrite cores 20 toward one another.

The ferrite cores 20 may be made by sintering powdered ferrite material in molds. Although they could simply be dumped from the molds into a storage container until they are needed, it is convenient to package them in a head-end to tail-end state prior to using them in core assemblies. It will be apparent to those skilled in the art that a variety of techniques might be used to package the ferrite cores 20. Several of these techniques are illustrated in FIGS. 6-9 (which are presented as examples, and not an exhaustive compilation of the possibilities).

Figure 6:
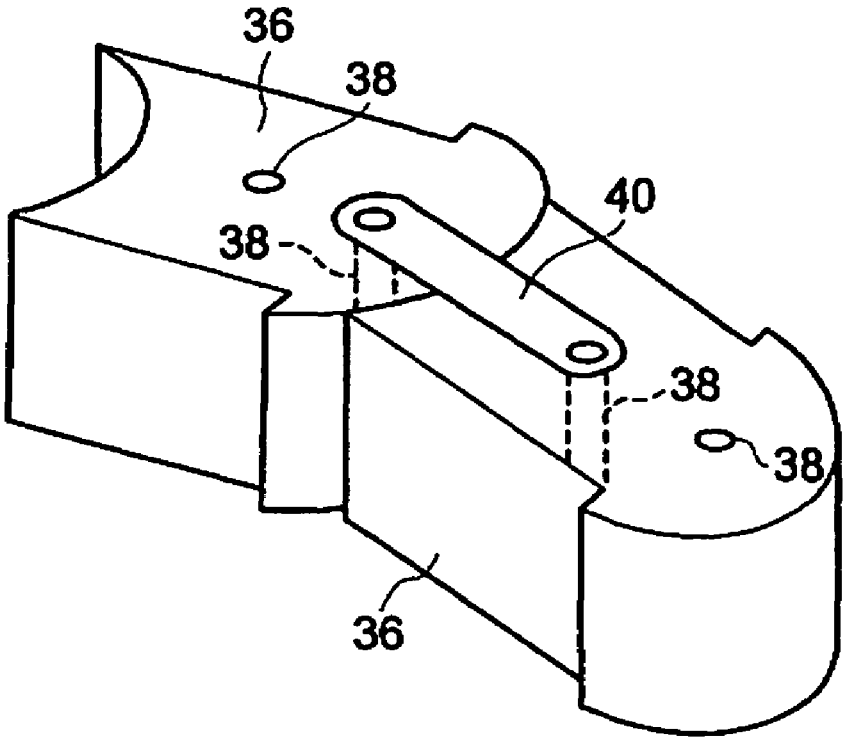
FIG. 6 is a perspective view of ferrite cores that are joined by a link.

In FIG. 6, the ferrite cores shown in FIG. 1 are modified to provide ferrite cores 36. The modification is that each core is provided with two bores 38. Links 40 can then be used above and below the cores 36 in order to join pins (not shown) that extend through the bores 38.

Figure 7:
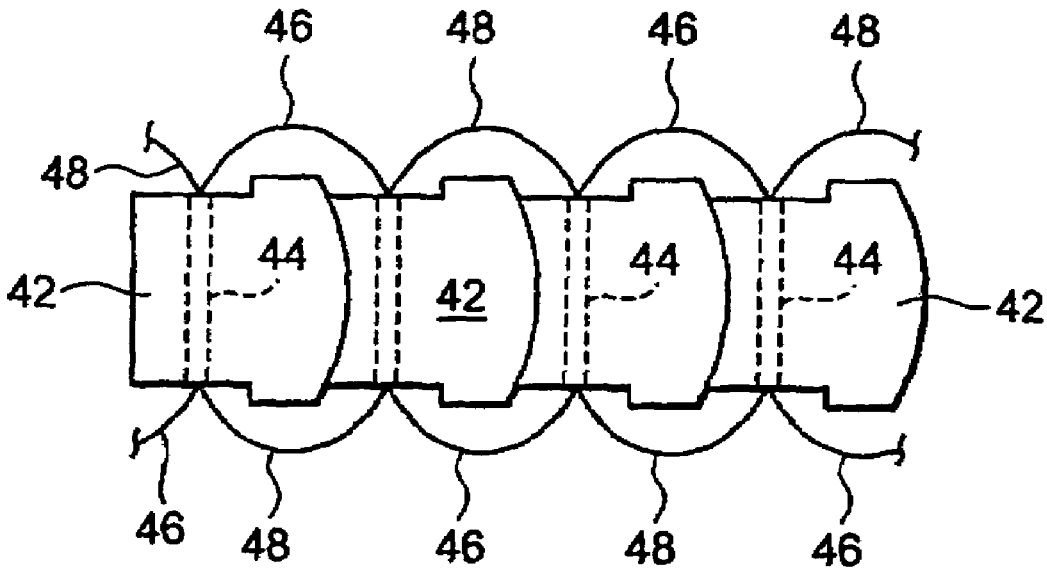
FIG. 7 is a top view of ferrite cores that are joined together in a group by filaments.

In FIG. 7, the cores shown in FIG. 1 are modified to provide ferrite cores 42, which have bores 44 that extend from side to side. A first filament 46 is looped through the bores 44, as is a second filament 48. The filaments 46 and 48 cross in a repeating figure-8 configuration. The filaments 46 and 48 are shown looping outward in FIG. 7 from the cores 42, but this is merely for purposes of illustration, and in reality they would be tightened. Strung together in this way, the cores 42 can then be wound on a reel for convenient storage.

Figure 8:
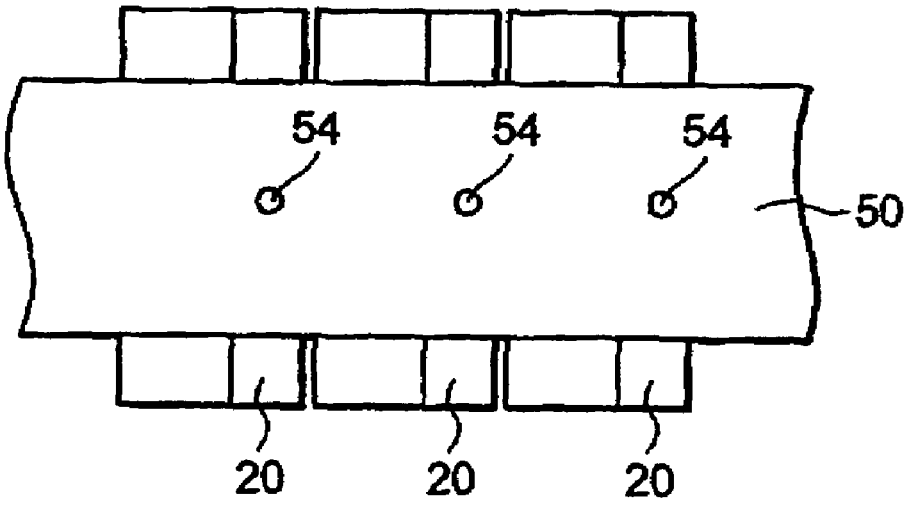
FIG. 8 is a top view of ferrite cores that are tacked to a tape.

In FIG. 8, ferrite cores 20 as shown in FIG. 1 are aligned, head to tail, beneath a tape 50 of elastic material. The tape 50 is attached to the cores 20 by small dabs of adhesive at tacking points 54.

Figure 9:
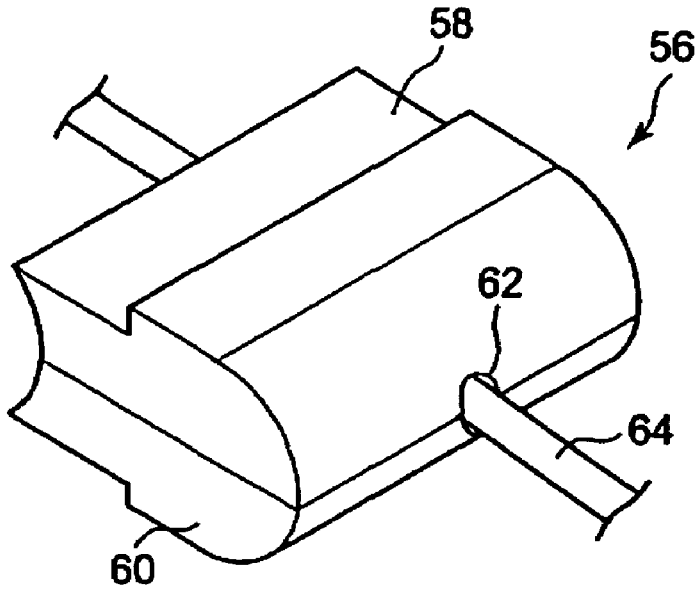
FIG. 9 is a perspective view of a ferrite core formed by joining top and bottom portions together, with a filament or cable running through a passage in the core.

FIG. 9 shows another modification of the ferrite core shown in FIG. 1. In FIG. 9, a ferrite core 56 is assembled from a top portion 58 and a bottom portion 60. The top portion 58 has a groove 62 that extends from the front end to the rear end. The bottom portion 60 has a similar groove, and an elastic filament 64 is disposed in these grooves and sandwiched between the top and bottom portions 58 and 60. The top and bottom portions 58 and 60 are connected with adhesive (or other joining means), either before or after the filament 64 is installed. Although not shown, cores 56 can be strung, one after the other, on the filament 64 for convenient storage. Furthermore, it is possible to enlarge the grooves and string the ferrite cores on a cable.

Second Embodiment

Figure 10:
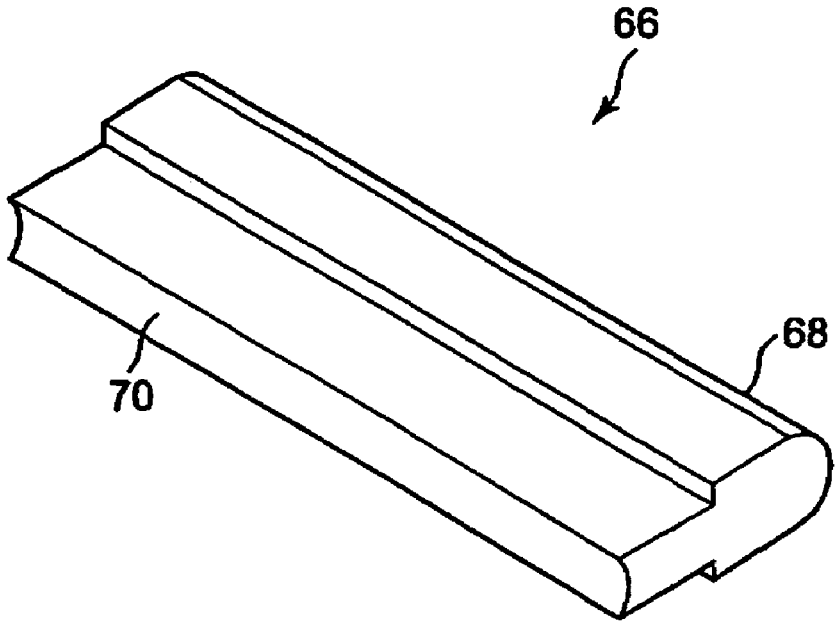
FIG. 10 is a perspective view of a ferrite core in accordance with the second embodiment of the invention.

FIG. 10 illustrates a second embodiment of a ferrite core in accordance with the present invention. The core 66 is similar to the core 20 shown in FIG. 1, but it has a width that is substantially greater.

The ferrite core 66 has a front or head end 68 with a curved, convex shape and a back or tail end 70 with a curved, concave shape. The head and tail end 70 are each configured as segments of a cylinder having approximately the same radius.

Figure 11:
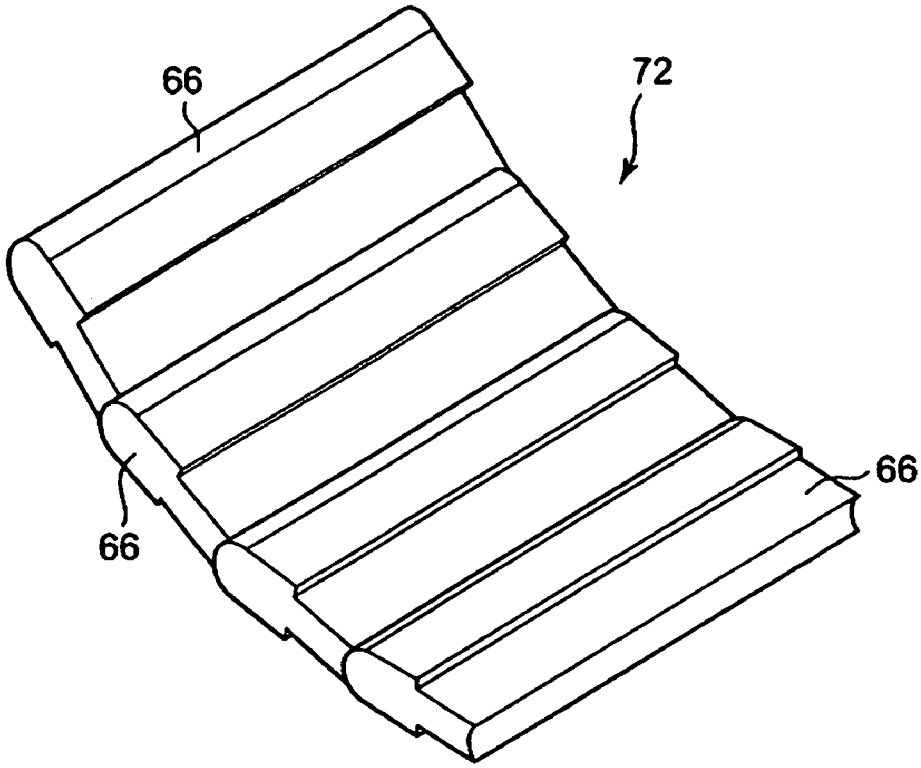
FIG. 11 is a perspective view illustrating how the ferrite cores of the second embodiment fit together.

FIG. 11 illustrates several of the ferrite cores 66 arranged, head-end to tail-end, to provide a ferrite core assembly 72. The core assembly 72 may be packaged using a variety of techniques, including those shown in FIGS. 6-9.

Figure 12:
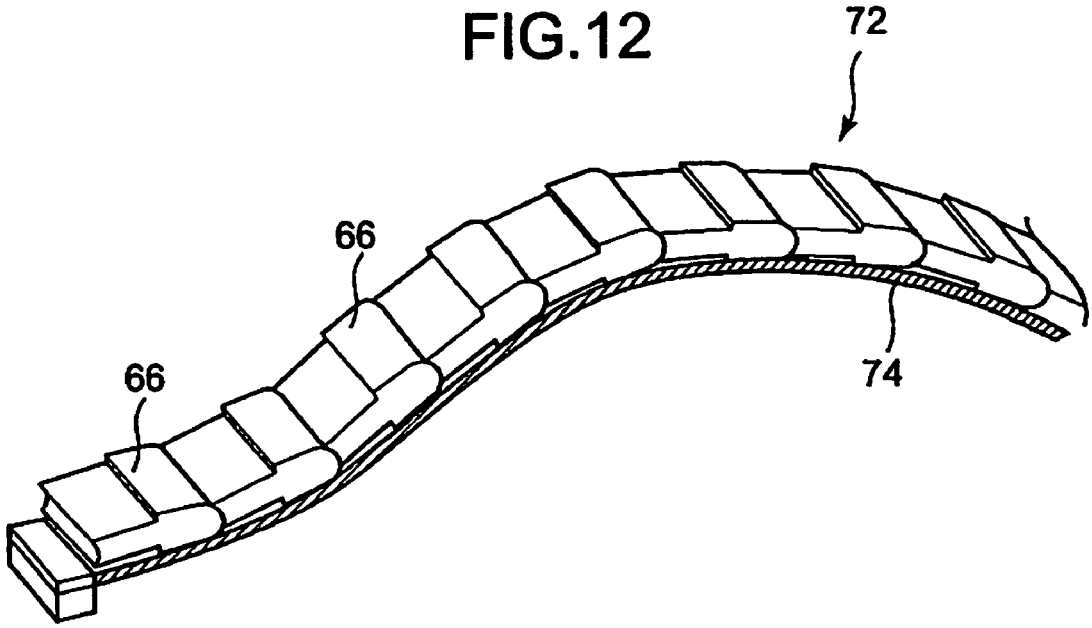
FIG. 12 is a view illustrating a ferrite core assembly that is made from cores of the second embodiment and that is attached to a flat cable.

In use, the core assembly 72 can be attached to the face of a flat cable 74 (such as a ribbon cable or flex cable) by adhesive (or other attachment means). This is shown in FIG. 12. Alternatively, it can be attached using a segment of a plastic, heat-shrink tube.

Third Embodiment

Figure 13:
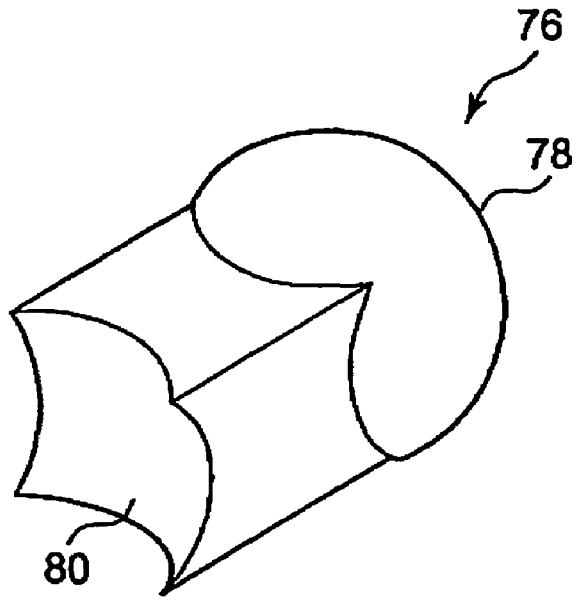
FIG. 13 is a perspective view of a ferrite core in accordance with the third embodiment of the present invention.

FIG. 13 illustrates a ferrite core 76 having a front or head end 78 and a rear or tail end 80. The head end 78 has a curved, convex shape, while the tail end 80 has a curved, concave shape. More particularly, the head end 78 is shaped as a segment of a sphere (or spherical cap) having a predetermined radius, and the tail end 80 is shaped as a segment of a sphere (or spherical cap) having the same predetermined radius (or a slightly larger radius).

Figure 14:
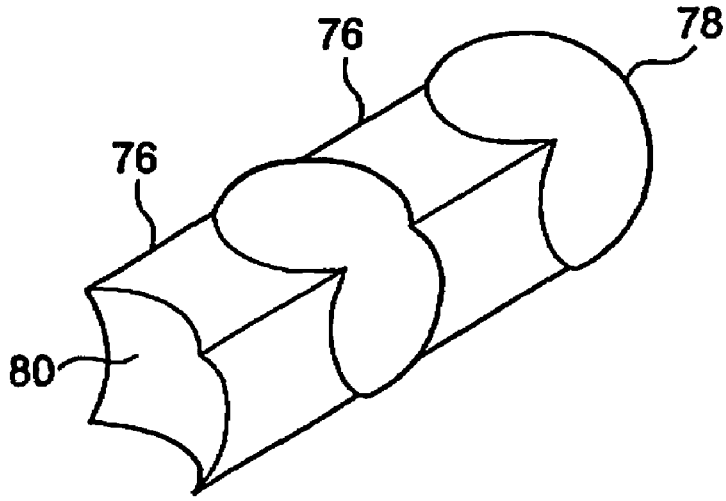
FIG. 14 is a perspective view illustrating how the ferrite cores of the third embodiment fit together.

It will be apparent that the head end 78 of one core 76 fits into the tail end 80 of an adjacent core 76 in the manner of a ball-and-socket joint. Such an arrangement is shown in FIG. 14. Strings of ferrite cores 76 arranged in this way can be used to form a toroidal core assembly, in the manner of FIG. 3 for the first embodiment, or a train of core assemblies 76 may be wrapped around a cable to form a helical core assembly. The core assemblies may be attached, for example, using adhesive or heat-shrink tubing.

Figure 15:
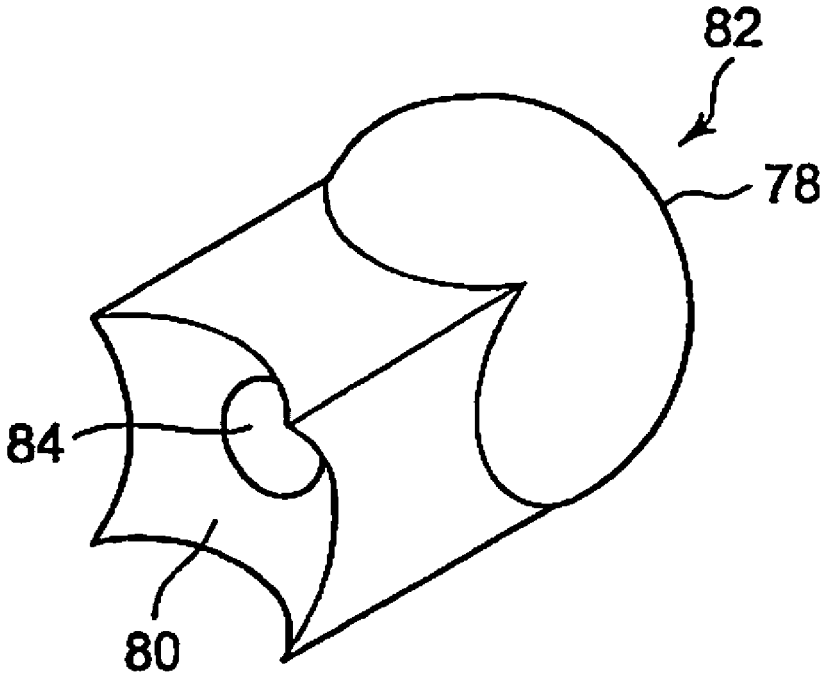
FIG. 15 is a perspective view illustrating a modification of the ferrite core of the third embodiment to provide a passage from the head end to the tail end.

The ferrite core 76 may be packaged by being linked together with filaments in the manner shown in FIG. 7 or by being tacked to an elastic tape in the manner illustrated in FIG. 8 (although it would be desirable for the tape to have circular apertures that would permit the sides of the head ends 78 to protrude). They can also be strung together on an elastic filament, and FIGS. 15 and 16 illustrate a modified ferrite core 82 having a bore 84 for this purpose.

Figure 16:
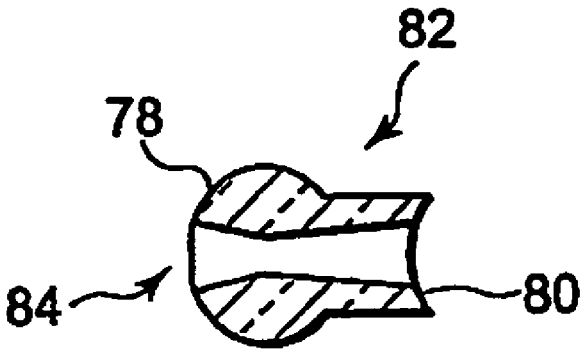
FIG. 16 is a cross sectional view of the modification shown in FIG. 15.

As is shown in FIG. 16, the bore is preferably flared at the head end 78 and the tail end 80. The flare is useful when an array of cores 82 is attached to a cable using a wire that runs through the bores 84, since the wire can then follow a path around the cable. Notches (not illustrated) may be provided in the head and tail ends so that the ends of the wires can be bent outward from the ring of cores 82 and twisted together to secure the core assembly about the cable.

Furthermore, it is possible to string the ferrite cores on a cable to suppress EMI radiation from the cable.

Figure 17:
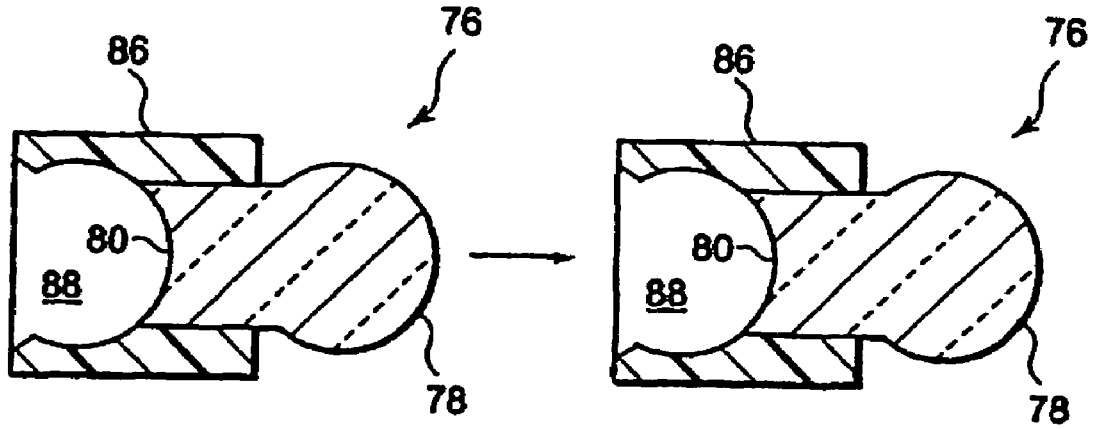
FIG. 17 is a cross sectional view illustrating another modification in which ferrite cores in accordance with the third embodiment are provided with plastic jackets, the plastic being somewhat compliant or flexible to permit the ferrite cores to be snapped together.

In FIG. 17, ferrite cores 76 as in FIG. 13 are provided with plastic jackets 86 in the region of the tail ends 80. The plastic that is selected for use in the jackets 86 should be somewhat compliant or flexible rather than rigid. The jackets 86 are open-ended, and provide cavities 88 in association with the tail ends 80. That is, the tail ends 88 together with the walls of the jacket 86 form recesses that are shaped as more than half of the surface of the sphere. These recesses provide sockets that permit the head end 78 of one core 76 to snap into the recess of an adjacent jacket to thereby hold the head end 78 against the adjacent tail end 80. The cores 76 can thus be strung together and, in use, formed into a toroidal core assembly around a cable or a helical core assembly around a cable.

It will be apparent to those ordinarily skilled in the art that the techniques disclosed herein with reference to one embodiment for packaging ferrite cores or assembling them into core assemblies attached to cables may also be used in other embodiments.

It will be understood that the above description of the present invention is susceptible to various other modifications, changes, and adaptations, and the same are intended to be comprehended within the meaning and range of equivalence of the appended claims.

What we claim is:

1. A ferrite core assembly for suppressing electromagnetic interference, comprising:

a plurality of ferrite cores, each having a respective head end with a rounded, convex shape and a respective tail end with a rounded, concave shape that provides a recess, each ferrite core additionally having an intermediate region between its head and tail ends, wherein each ferrite core comprises sintered material at the head end thereof, sintered material at the tail end thereof, and sintered material at the intermediate region thereof, wherein the ferrite cores are assembled in articulated, flexible sequence such that the head ends of at least some of the ferrite cores extend into the recesses of adjacent ferrite cores, and wherein the head ends of the ferrite cores have approximately the shape of a spherical cap of a sphere with a predetermined radius, and the tail ends of the ferrite cores have approximately the shape of a spherical cap of a sphere with a radius that is approximately the same as the predetermined radius.

2. The core assembly of claim 1, wherein the core assembly conforms to a cable around which the core assembly is wrapped at least once.

3. The core assembly of claim 1, wherein the core assembly is affixed to a side of a flat cable and extends along at least a portion of the length thereof.

4. The core assembly of claim 1, further comprising plastic jackets attached to the ferrite cores adjacent the tail end thereof, each plastic jacket having a cavity that communicates with the recess at the tail end of the respective ferrite core, the cavity being configured to receive the head end of an adjacent one of the ferrite cores and to lock onto the head end of said adjacent one of the ferrite cores.

5. The core assembly of claim 1, in combination with means for attaching the core assembly to a cable.

6. The core assembly of claim 5, wherein the means for attaching comprises heat-shrunk plastic tubing.

7. The core assembly of claim 1, wherein each ferrite core has a bore extending from the head end thereof to the tail end thereof.

8. The core assembly of claim 7, wherein the bore flares outward at the head end and also at the tail end.

9. The core assembly of claim 1, wherein the sintered material includes at least one substance selected from the group consisting of MnZn and NiZn as a principle ingredient.

10. The core assembly of claim 1, wherein each ferrite core has top, bottom, left, and right outer side surfaces that extend from the head end thereof to the tail end thereof, the top, bottom, left, and right outer side surfaces having shapes that are substantially the same in configuration.

11. The core assembly of claim 1, wherein the spherical cap at the head end of each of the ferrite cores has an area that is greater than the area of a hemisphere having the predetermined radius.

12. A plurality of ferrite cores in combination with means for joining the ferrite cores together in a flexible sequence, wherein each ferrite core has a convex head end and a concave tail end providing a recess at the tail end of the respective ferrite core, the head and the tail ends both being shaped substantially as a portion of a round ball, each ferrite core additionally having an intermediate region between the head and tail ends of the respective ferrite core, wherein each ferrite core comprises sintered material at the head end thereof, sintered material at the tail end thereof, and sintered material at the intermediate region thereof; and wherein the means for joining connects the ferrite cores one after another with ball-and-socket joints, the ferrite cores being oriented so that the head ends all face in a first direction and the tail ends all face in a second direction that is opposite to the first direction.

13. The combination of claim 12, wherein the ferrite cores have bores, and the means for joining comprises at least one filament extending through the bores.

14. The combination of claim 12, wherein each ferrite core has top, bottom, left, and right outer side surfaces that extend from the head end thereof to the tail end thereof, the top, bottom, left, and right outer side surfaces having shapes that are substantially the same in configuration.

15. The combination of claim 12, wherein the sintered material includes at least one substance selected from the group consisting of MnZn and NiZn as a principle ingredient.

16. A ferrite core for use in a ferrite core assembly to suppress electromagnetic interference radiated from a signal-carrying cable to which the ferrite core assembly is attached, said ferrite core comprising:

a body having a curved head end with a rounded, convex shape and having a curved tail end with a rounded, concave shape, the concave shape conforming substantially to the convex shape, the body additionally having an intermediate region between its head and tail ends, wherein the head end of the body is shaped approximately as a spherical cap of a sphere with a predetermined radius, and the tall end of the body is shaped approximately as a spherical cap of a sphere with a radius that is the same as the predetermined radius, and wherein the body comprises sintered ferrite material at the head end thereof, sintered ferrite material at the tail end thereof, and sintered ferrite material at the intermediate region thereof.

17. The ferrite core of claim 16, wherein the body has top, bottom, left, and right outer side surfaces that extend from the head end thereof to the tail end thereof, the top, bottom, left, and right outer side surfaces having shapes that are substantially the same in configuration.

18. The ferrite core of claim 16, wherein the spherical cap at the head end has an area that is greater than the area of a hemisphere having the predetermined radius.

19. The ferrite core of claim 16, wherein the sintered material includes at least one substance selected from the group consisting of MnZn and NiZn as a principle ingredient.

* * * * *